US007250213B2

(12) United States Patent
Duncan

(10) Patent No.: US 7,250,213 B2
(45) Date of Patent: Jul. 31, 2007

(54) TEXTURED WIRE TIE AND METHODS OF MAKING SAME

(75) Inventor: David Duncan, Hickory, NC (US)

(73) Assignee: American Wire Tie Inc., North Collins, NY (US)

( * ) Notice: Subject to any disclaimer, the term of this patent is extended or adjusted under 35 U.S.C. 154(b) by 0 days.

(21) Appl. No.: 10/687,014

(22) Filed: Oct. 16, 2003

(65) Prior Publication Data

US 2005/0084674 A1 Apr. 21, 2005

(51) Int. Cl.
*B32B 15/00* (2006.01)
*B65D 77/18* (2006.01)

(52) U.S. Cl. ..... 428/379; 428/375; 428/399; 428/400; 24/30.5 R; 24/27; 24/303 P; 24/305 T

(58) Field of Classification Search ..... 428/375, 428/379, 383, 399, 400; 24/30.5 R, 30.5 P, 24/30.5 T
See application file for complete search history.

(56) References Cited

U.S. PATENT DOCUMENTS 2,767,113 A * 10/1956 Bower ..... 428/156
3,023,483 A 3/1962 Steiner
3,290,854 A * 12/1966 McMurray ..... 53/417
3,409,948 A * 11/1968 Goodwin ..... 24/16 R
3,426,393 A * 2/1969 Mead ..... 24/30.5 T
3,528,852 A * 9/1970 Arndt et al. ..... 428/383
3,542,321 A * 11/1970 Kahabka ..... 248/205.3
3,548,906 A * 12/1970 Murphy ..... 383/25
3,565,738 A * 2/1971 Kirkpatrick ..... 383/62
3,579,409 A 5/1971 Shannon
3,668,741 A * 6/1972 Grossbudde ..... 24/27
3,703,421 A * 11/1972 Fisher ..... 156/166
3,761,346 A 9/1973 Caroselli et al.
3,857,139 A * 12/1974 Turner ..... 24/30.5 T
3,906,139 A * 9/1975 Hiraoka et al. ..... 428/383
4,031,284 A * 6/1977 Ingraham ..... 428/222
4,145,030 A * 3/1979 Ingraham ..... 256/1
4,246,317 A 1/1981 Helwig
4,330,956 A * 5/1982 McCarthy ..... 43/4
4,637,516 A * 1/1987 de Roure ..... 206/471
4,679,387 A * 7/1987 Weidenhaupt et al. ..... 57/212
4,797,313 A * 1/1989 Stolk et al. ..... 428/156
4,915,996 A * 4/1990 Curry ..... 428/40.9
5,154,964 A * 10/1992 Iwai et al. ..... 428/156
5,238,631 A * 8/1993 Stolk et al. ..... 264/147
5,342,687 A * 8/1994 Iwai et al. ..... 428/402
5,490,529 A 2/1996 Fitjer
5,655,224 A * 8/1997 Sears ..... 2/171
5,711,143 A 1/1998 Munakata et al.
5,727,357 A 3/1998 Arumugasaamy et al.
5,851,737 A 12/1998 Maruyama
6,372,068 B1 * 4/2002 Kincel et al. ..... 156/73.2
6,527,482 B1 3/2003 Stankus (Continued)

FOREIGN PATENT DOCUMENTS

EP 822431 2/1998

(Continued)

*Primary Examiner*—Jill Gray
(74) *Attorney, Agent, or Firm*—Banner & Witcoff, Ltd.

(57) ABSTRACT

This invention relates to a textured tie wire product, and more particularly to rebar tying applications, bundling, and packaging applications. The invention also relates to methods of making textured tie wire products.

7 Claims, 3 Drawing Sheets

U.S. PATENT DOCUMENTS

| | | | | |
|---|---|---|---|---|
| 6,673,413 | B1 * | 1/2004 | Kincel et al. | 428/99 |
| 6,678,921 | B2 * | 1/2004 | Despault et al. | 24/16 PB |

FOREIGN PATENT DOCUMENTS

| | | | |
|---|---|---|---|
| JP | 3210706 | | 9/1991 |
| JP | 4249813 | | 9/1992 |
| JP | 5111912 | | 5/1993 |
| JP | 11247078 | | 9/1999 |
| JP | 200173357 | | 6/2000 |
| WO | WO 02/18726 | A1 * | 3/2002 |

* cited by examiner

TEXTURED WIRE TIE AND METHODS OF MAKING SAME

FIELD OF THE INVENTION

A tie wire having a textured coating and methods of making a textured tie wire.

BACKGROUND

Metal tying wire products are useful in many building and packaging applications and specifically in industrial building and packaging applications. Tying wires are useful in securing reinforcing rods or bars, such as rebar, during the construction of structures and for packaging goods that need protection against corrosion, salt, or abrasives.

Tie wires are known to unwind after they are twisted in place to secure or support items. To overcome this, tie wires are commonly twisted 4 or more times to create a more secure tie. Currently known tie wires are also very slippery when wet, which make them more difficult to handle and install during inclement conditions.

It is an object of the present invention to provide a tie wire product that prevents slippage, increases knot strength with fewer twists, and reduces installation time. It is another object to provide a safe tie wire that protects against corrosion, salt, and abrasives. Particular objects and advantages of the textured tie wires will be apparent to those skilled in the art, that is, those who are knowledgeable or experienced in this field of technology, in view of the following disclosure of the invention and detailed description of certain preferred embodiments.

SUMMARY

In accordance with a first aspect, a textured tie wire comprises a textured coating adhered to the outer surface of a metal wire. The coating is made of a first and a second plastic resin having different molecular weights or melt indexes.

In accordance with certain embodiments, the first resin is a hot melt adhesive and colorant having a melt index from between about 14 to about 19 and the second resin is a fractional melt resin having a melt index between about 0.3 to about 0.9.

In accordance with other embodiments, the first resin is from about 50% to about 60% by weight of the coating and the second resin is from 40% to about 50% by weight of the coating.

In accordance with a second aspect, is a method of making a textured tie wire, comprising melting a mixture of from about 50% to about 60% by weight hot melt adhesive and colorant having a melt index from between about 14 to about 19 and from 40% to about 50% fractional melt resin having a melt index between about 0.3 to about 0.9 to form a melt blend. The melt blend is then extruded at a temperature from about 250° F. to about 350° F. The melt blend is then applied to a wire and adheres to the outer surface of the wire.

Substantial advantage is achieved by providing a textured tie wire that is resistant to slippage and ties with fewer twists and less effort. Substantial advantage is also achieved by providing a method of making such a tie wire. In particular, the tie wires provided here resist slippage when wet, reduce the time of installation, and improve knot strength with fewer twists. This is highly advantageous since tie wires are often installed in inclement or extremely humid conditions.

These and additional features and advantages of the invention disclosed here will be further understood from the following detailed disclosure of certain preferred embodiments.

Figures 1, 2:
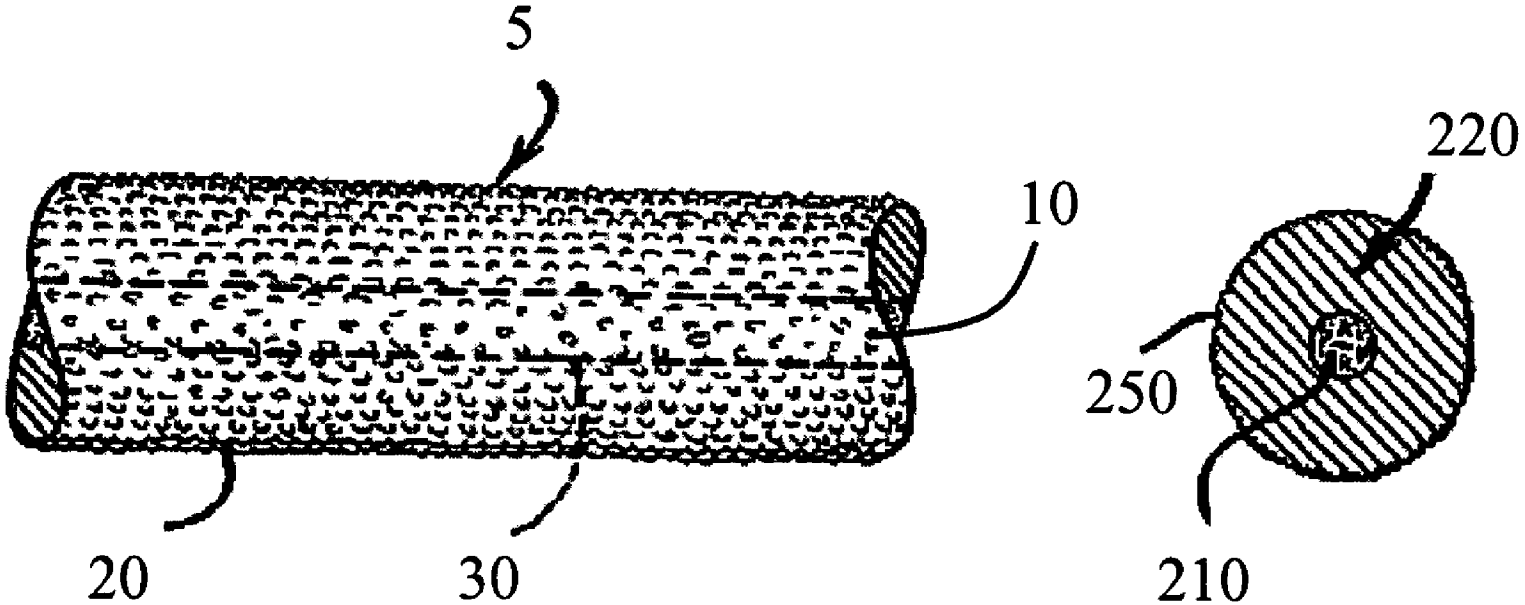
FIG. 1 is a side view of a textured tie wire.
FIG. 2 is a cross section of a textured tie wire.

The figures referred to above are not drawn necessarily to scale and should be understood to present a representation of the tie wires disclosed herein and illustrative of the principles involved. Some features of the tie wires depicted in the drawings have been enlarged or distorted relative to others to facilitate explanation and understanding. The same reference numbers are used in the drawings for similar or identical components and features shown in various alternative embodiments. Tie wires and methods of making tie wires as disclosed herein, will have configurations and components determined, in part, by the intended application and environment in which they are used.

DETAILED DESCRIPTION OF CERTAIN PREFERRED EMBODIMENTS

The tie wires may be embodied in various forms, and in reference to FIG. 1, and according to one embodiment, a side-view of a textured tie wire 5 is shown in which wire 10 forms the core of the textured tie wire. Textured coating 20 forms a sleeve, which wholly surrounds wire 10. Textured coating 20 is adhered to the outer surface 30 of wire 10. As used herein, adhered is intended to include such concepts as, for example, bonded, adhered, attached, fixed, and the like.

In reference to FIG. 2, a cross-section of a textured tie wire 50 is shown. Textured coating 220 is adhered to the outer surface of wire 210 to form a textured tie wire 250.

Textured as used here is intended to include, for example, a roughened quality such as a roughened surface of irregular shape, a taffeta texture, ribs, a pebbled appearance, fine specks of irregular shape, or similar patterns that are not smooth. The textures can also be replicas of or mimic naturally occurring textures, for example, an alligator skin appearance, a sponge-like appearance, wood grain, leather, or the like. The textures can be either homogenous or not homogenous.

The textured coating may have friction-increasing effects, which are operative to reduce slippage of the tie wire. The textured coating in accordance with the present description may have, for example, a level of surface roughness sufficient for reducing slippage of the wire on itself and for reducing slippage of the wire in the hands of the installer, whether covered or uncovered. Surface roughness of at least about 1 micron provide a satisfactorily textured coating, and a surface roughness of between about 1 micron and 1000 microns is also satisfactory.

As used herein, the plastic coating may be made of mixtures of plastics such as, ethyl vinyl acetate (EVA) high density polyethylene (HDPE), polypropylene (PP), polyvinyl chloride (PVC), polyolefin, blends of EVA, HDPE, PP, or PVC, acrylic resins, or other suitable materials. Those with skill in the art having the benefit of this disclosure would know how to select a suitable plastic for a particular purpose.

A suitable mixture of plastics may be for example, hot melt adhesive and colorant having a melt index from between about 14 to about 19 and fractional melt resin having a melt index between about 0.3 to about 0.9. Without wishing to be bound by any scientific explanation, it is believed that the higher melt index resin has a greater tendency to relax in a direction normal to the plane of the surface covering to provide the desired textured effect.

According to one aspect, a coating may be made from about 50% to about 70% by weight hot melt adhesive and colorant having a melt index from between about 14 to about 19 and from 30% to about 50% fractional melt resin having a melt index between about 0.3 to about 0.9. According to another aspect the coating may be made from about 60% by weight hot melt adhesive and colorant having a melt index from between about 14 to about 19 and about 40% by weight fractional melt resin having a melt index between about 0.3 to about 0.9. Suitable polymers are available commercially from Dow Chemical, for example Primacore 3440. LR580 and 3364 also available from Dow Chemical. Other suitable polymers are available commercially from, for example, Airostar, Exxon, Matrix, Aamco.

According to certain aspects, the coating may be from between about 0.005 to about 0.15 inches thick. The coating may be of a uniform thickness around the wire, or it may vary in thickness. This may be due to the way in which the coating is applied or due to the nature of the textured surface.

According to another aspect, the wire may be from 0.04 to about 0.80 inches in diameter. According to another aspect, the wire may be about 0.06 inches in diameter. The wire may be a metal wire, for example, a steel wire, a stainless steel wire, an aluminum wire, a copper wire or any other suitable wire a person with skill in the art would determine appropriate for a particular purpose. The wire may be a single strand of wire or it may be made of multiple strands. According to other aspects, the wire may have a tensile strength of between about 30,000 to about 75,000 psi. The appropriate diameter and tensile strength of the wire will largely be determined based on the intended purpose for using the textured tie wire. One of skill in the art, having the benefit of this disclosure, would be able to determine the appropriate wire diameter and tensile strength for a particular purpose.

As will readily be appreciated, the addition of colorants to the textured coating formulations provides a convenient method for imparting permanent coloration to the textured coatings, for example, as a color-coding or identification purposes. According to one aspect, the colorant is a component of one of the plastic resins comprising the melt blend. Suitable colorants are available commercially from Tecknor Colorant. A person of skill in the art, having the benefit of this disclosure would be able to determine the proper amount of colorant for a particular purpose. The amount of colorant added to the melt blend will be determined in part by the final purpose of the colorant, for example, for color coating. For example, from about 0% to about 25% of the first resin may be colorant.

According to certain embodiments, the textured wire may be made, for example, by melting a mixture of from about 50% to about 70% by weight hot melt adhesive and colorant having a melt index from between about 14 to about 19 and from 30% to about 50% fractional melt resin having a melt index between about 0.3 to about 0.9 to form a melt blend. The mixture may be melted and mixed in the reservoir of a melt-blending extruder, in a mixer, by hand, or by any apparatus a person with skill in the art, having the benefit of this disclosure, would determine appropriate for a particular purpose. Once the mixture of the polymers has been mixed to form a melt blend, the melt blend may be extruded through an extrusion head at a temperature from about 250° F. to about 350° F.

According to certain aspects, the melt blend may be applied to the wire, for example, by continuously applying as a liquid overcoating. Application of the coating may be accomplished, for example, utilizing known continuous coating processes and apparatuses. For example, the melt bled mixture, comprising a liquid mixture of from about 50% to about 70% by weight hot melt adhesive and colorant having a melt index from between about 14 to about 19 and from 30% to about 50% fractional melt resin having a melt index between about 0.3 to about 0.9, is applied directly from a liquid coating die to the wire at a liquid temperature of between 250° F. to about 350° F. as the wire is continuously drawn through the die. The coating die may be a pressure coating die, or the like. The die orifice and pressure of the liquid mixture in the die are adjusted to provide a liquid coating of approximately 0.005 to about 0.15 inch thick on the surface of the coated fiber, such that the diameter of the coated wire is approximately from about 0.045 to about 0.85 inches.

The melt blend may be also applied to the wire, for example, by spraying the melt blend on the wire, by drawing the wire through extruded melt blend, by brushing the melt blend on the wire, or the like. Those with skill in the art having the benefit of this disclosure would be able to determine the most appropriate way of applying the melt blend to a wire for their particular purpose.

According to certain aspects, the melt blend adheres to the outside and end surfaces of the wire. The coating adheres or bonds to form a coating that is not easily disturbed or removed during the installation and use of the textured coated tie wires.

Following this application step, the coated wire may be dried and/or cooled by drawing the coated wire through a furnace, by drawing the coated wire through water, by a conventional optical fiber cooling tube, or by passage of the coated wire through a fine water spray.

The above example may also be made with a melt blend mixture, for example, of from about 60% by weight high hot melt adhesive and colorant having a melt index from between about 14 to about 19 and about 40% by weight fractional melt resin having a melt index between about 0.3 to about 0.9 at 310° F. The melt bled mixture can be made from any mixture of two plastic resins which are of differing molecular weight that a person of skill in the art having the benefit of this disclosure would find appropriate for a particular purpose.

The textured coating of wire, according to certain aspects, may be made from a mixture of two or more foamed polyvinyl chloride resins having differing molecular weights. Foamed polyvinyl chloride formulations are well known, being currently marketed as flexible or rigid foamed materials of open-celled or closed-cell structure. These foams are widely used for a variety of applications including clothing, synthetic leather, upholstery, construction materials, and the like.

The textured coating may also be applied by the process of vacuum forming. Such vacuum forming techniques are well known in the art. Other suitable techniques of applying the textured coating may also be used and will be readily understood by those with skill in the art having the benefit of this disclosure.

According the certain aspects, and during the application of the melt blend to the wire, the wire is coated or surrounded with from between about 0.005 to about 0.15 inches of the melt blend. In certain other aspects, the wire is coated with about 0.018 inches of the melt blend. The thickness of the layer of melt blend applied to the wire will largely be determined by the intended usage of the textured coated wire. For example, a wire used for tying rebar may need a different thickness of coating than a wire used for securely closing a chemical container or a wire securing a package for shipment. According to other aspects, the finished textured tie wire product will have a diameter of from between 0.045 to about 0.85 inches. One of skill in the art, having the benefit of this disclosure, would be able to choose the appropriate thickness of coating for a particular purpose.

Figure 3:
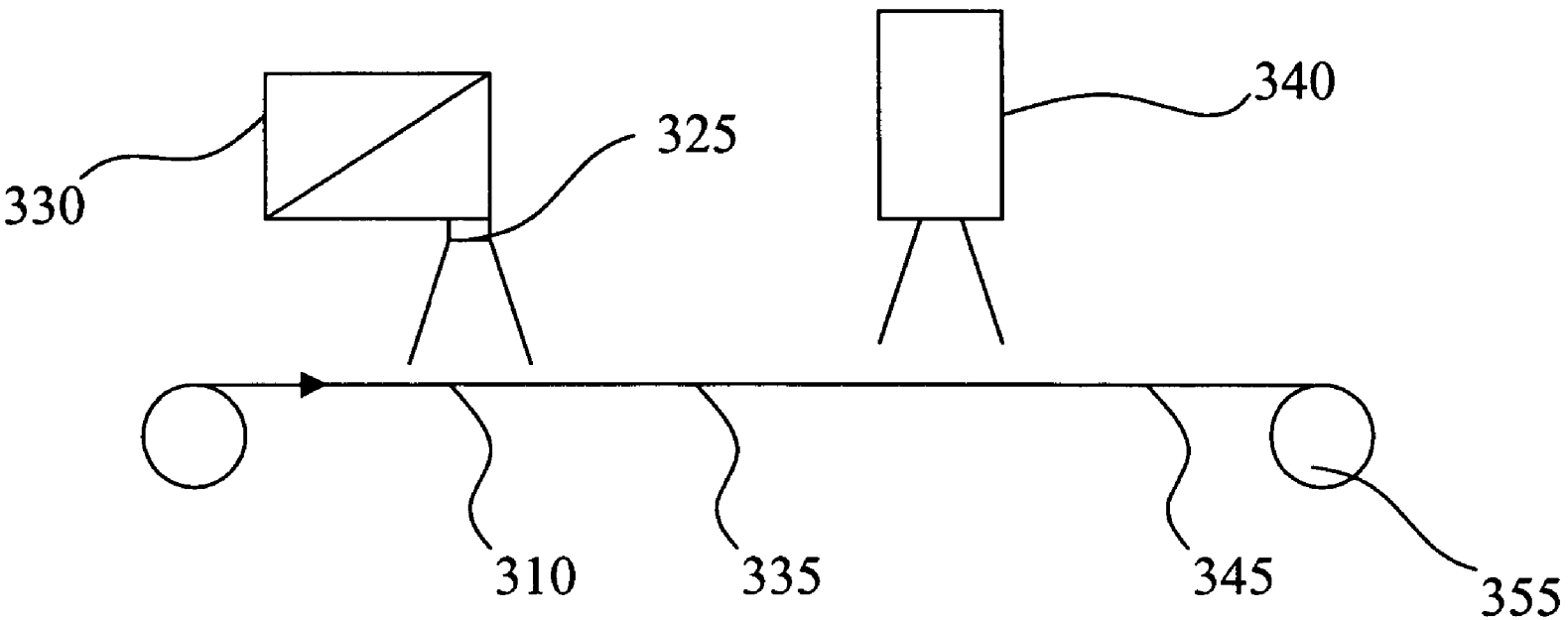
FIG. 3 is a process diagram of the method of making a textured tie wire.

In reference to FIG. 3, a process diagram is shown for one aspect of a method of making a textured tie wire. A wire 310 is drawn through a continuous flow of melt blend being extruded from die 325 of extruder 330. The extruder may be, for example, a single-screw, multiple-screw, ram, or rotary screwless extruder. The coated wire 335 is then passed through a fine mist spry of water from mister 340. The cooled coated wire 345 is then wound onto spool 355.

Figure 4:
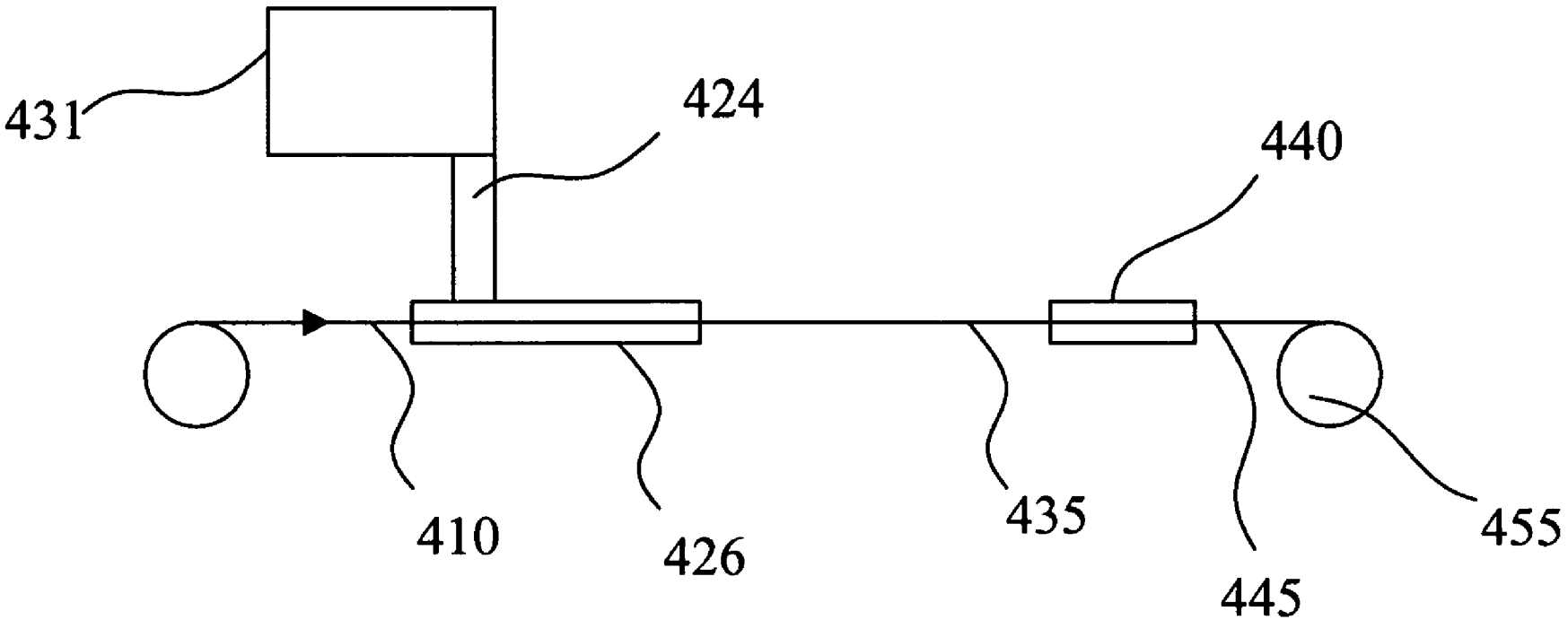
FIG. 4 is a process diagram of the method of making a textured tie wire.

In reference to FIG. 4, another example of the method of making a textured tie wire is shown in a process diagram. A mixture of two polyvinyl chloride polymers of differing molecular weights, for example, a mixture of about 60% by weight hot melt adhesive and colorant having a melt index from between about 14 to about 19 and about 40% by weight fractional melt resin having a melt index between about 0.3 to about 0.9, is heated to about 310° F. and mixed in mixer 431 to form a melt blend. The melt blend is then passed from the mixer and fed into coating apparatus 426. The coating apparatus 426 applies the melt bled to the outer surface of wire 410. The coated wire 435 is then passed or drawn through cooling tube 440 and cooled. The cooled coated textured tie wire 440 is wound onto spool 455.

While the textured tie wires and methods of making textured tie wires has been described with respect to specific examples including presently preferred modes of carrying out the invention, those skilled in the art will appreciate that there are numerous variations and permutations of the above described textured tie wires and methods of making textured tie wires that fall within the spirit and scope of the invention as set forth in the appended claims.

I claim:

1. A textured wire tie comprising a frictional textured coating adhered to a surface of a metal wire having a tensile strength of between about 30,000 to about 75,000 pounds per square inch, wherein the coating comprises a melt blend of a first plastic resin having a first melt index between about 14 to about 19 and a second plastic resin having a second melt index between about 0.3 to about 0.9 such that, upon the melt blend being applied to the metal wire, and solidified, the difference between the first plastic resin's melt index and the second plastic resin's melt index causes formation of a roughened outer surface of the textured coating that reduces slippage of the textured wire tie on itself when twisted, or slippage during handling.

2. The textured wire tie of claim 1, wherein the first and second resins are polyvinyl chloride.

3. The textured wire tie of claim 1, wherein the first resin is a high density fractional melt polyvinyl chloride and the second resin is a 0.3 fractional melt polyvinyl chloride.

4. The textured wire tie of claim 3, wherein the first resin is from about 50% to about 70% by weight of the coating and the second resin is from 30% to about 50% by weight of the coating.

5. The textured wire tie of claim 3, wherein the first resin is about 60% by weight of the coating and the second resin is about 40% by weight of the coating.

6. The textured wire tie of claim 1, wherein the coating is from between about 0.005 to about 0.05 inches thick.

7. The textured wire tie of claim 1, wherein the wire is from 0.04 to about 0.80 inches in diameter.

* * * * *